US005326297A

United States Patent [19]

Loughlin

[11] Patent Number: 5,326,297

[45] Date of Patent: Jul. 5, 1994

[54] LIFE JACKET

[76] Inventor: Keith O. Loughlin, Loughash Road, Newmarket An Fergus, Co-Clare, Ireland

[21] Appl. No.: 27,641

[22] Filed: Mar. 8, 1993

[51] Int. Cl.[5] ..... B63C 9/20

[52] U.S. Cl. ..... 441/89; 2/102; 441/115

[58] Field of Search ..... 441/89, 111, 115, 124, 441/116; 2/102

[56] References Cited

U.S. PATENT DOCUMENTS

| | | | |
|---|---|---|---|
| 1,629,429 | 5/1927 | Adams | 441/115 |
| 2,118,708 | 5/1938 | Johnson | 441/111 |
| 3,106,184 | 10/1963 | Shea | 441/89 X |
| 3,638,258 | 2/1972 | Black | 441/89 |
| 3,798,692 | 3/1974 | Madely | 441/89 |
| 4,241,459 | 12/1980 | Quayle | 2/102 |
| 5,029,293 | 7/1991 | Fontanille | 441/89 X |

FOREIGN PATENT DOCUMENTS

| | | | |
|---|---|---|---|
| 1027547 | 4/1958 | Fed. Rep. of Germany | 441/89 |
| 3625812 | 2/1988 | Fed. Rep. of Germany | 441/89 |

*Primary Examiner*—Sherman Basinger

[57] ABSTRACT

A life vest which is adapted with various signaling devices is disclosed. This life vest is designed to be worn by a person while traveling via water. The vest is designed with various pouches and attachments for safety receptacles. It is adapted to hold a flare gun with flares, a strobe, a solar powered flare signal and a signal balloon. The vest is also adapted for attachment of a signaling device which may both transmit a signal and produce an audio signal.

9 Claims, 4 Drawing Sheets

LIFE JACKET

BACKGROUND OF THE INVENTION

1. Field of the Invention

The present invention relates generally to emergency equipment and more particularly, to safety equipment used at sea adapted to hold signaling devices and produce distress signals with these devices.

2. Description of the Prior Art

Equipment used at sea for safety and distress signaling is well known. For example, in U.S. Pat. No. 5,021,794 dated, Jun. 4, 1991, there is disclosed a miniature transceiver concealed on a person which transmits a coded UHF homing signal upon receipt of a coded initiation signal U.S. Pat. No. 5,014,340, dated May. 7, 1991, discloses a transmitter generating three sequential signals for use in identifying a particular transmitter. U.S. Pat. No. 4,932,910, dated Jun. 12, 1990, disclosed an emergency location marker system carried by a vessel for marking a location on the water and signaling. Similarly, U.S. Pat. No. 4,819,860, dated Apr. 11, 1989, discloses a wrist mounted monitor which stores upper and lower emergency levels and transmits an emergency signal when the levels are detected. Finally, U.S. Pat. No. 4,815,677, dated Mar. 28, 1989, discloses a helium locator balloon having streamer strips attached constituting tuned radar reflective dipole strips. Each device is suitable for sending certain signals. They are, although, lacking adaption for use by a person thrown overboard. The need exists for a device adapted to be attached to a person at sea which includes numerous locating devices. There are more than one device included in the event that some devices do not work or are defective. It is also necessary to include a device which is activated upon entrance into the water, in case the user is in shock and, thus, unable to activate the device.

SUMMARY OF THE INVENTION

To achieve the foregoing and other advantages, the present invention, briefly described, provides a life vest which is adapted with various signaling devices. This life vest is designed to be worn by a person while traveling via water. The vest is designed with various pouches and attachments for safety receptacles. It is adapted to hold a flare gun with flares, a strobe, a solar powered flare signal and a signal balloon. The vest is also adapted for attachment of a signaling device which may both transmit a signal and produce and audio signal.

The above brief description sets forth rather broadly the more important features of the present invention in order that the detailed description thereof that follows may be better understood, and in order that the present contributions to the art may be better appreciated. There are, of course, additional features of the invention that will be described hereinafter and which form the subject matter of the claims appended hereto.

In this respect, before explaining at least the preferred embodiments of the invention in detail, it is to be understood that the invention is not limited in its application to the details of the construction and to the arrangements of the components set forth in the following description or illustrated in the drawings. The invention is capable of other embodiments and of being practiced and carried out in various ways. Also, it is to be understood, that the phraseology and terminology employed herein are for the purpose of description and should not be regarded as limiting.

As such, those skilled in the art will appreciate that the conception, upon which this disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

Further, the purpose of the foregoing Abstract is to enable the U.S. Patent and Trademark Office and the public generally, and especially the scientists, engineers and practitioners in the art who are not familiar with patent or legal teems of phraseology, to determine quickly from a cursory inspection the nature and essence of the technical disclosure of the application. Accordingly, the Abstract is neither intended to define the invention or the application, which only is measured by the claims, nor is it intended to be limiting as to the scope of the invention in any way.

It is therefore an object of the present invention to provide a new and improved life jacket which has all of the advantages of the prior art and none of the disadvantages.

It is another object of the present invention to provide a new an improved life jacket which may be easily and efficiently manufactured and marketed.

It is a further objective of the present invention to provide a new and improved life jacket which is of durable and reliable construction.

An even further object of the present invention is to provide a new and improved life jacket which is susceptible of a low cost of manufacture with regard to both materials and labor, and which accordingly is then susceptible of low prices of sale to the consuming public, thereby making such life jacket available to the buying public.

Still yet a further object of the present invention is to provide a new and improved life jacket which is adapted to include numerous signaling devices.

It is still a further object of the present invention is to provide a new and improved life jacket in which at least one signaling device is activated automatically upon entry into water.

These together with still other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and the above objects as well as objects other than those set forth above will become more apparent after a study of the following detailed description thereof. Such description makes reference to the annexed drawings wherein.

DESCRIPTION OF THE PREFERRED EMBODIMENT

With reference now to the drawings, a new and improved life vest embodying the principles and concepts of the present invention will be described.

Figure 1:
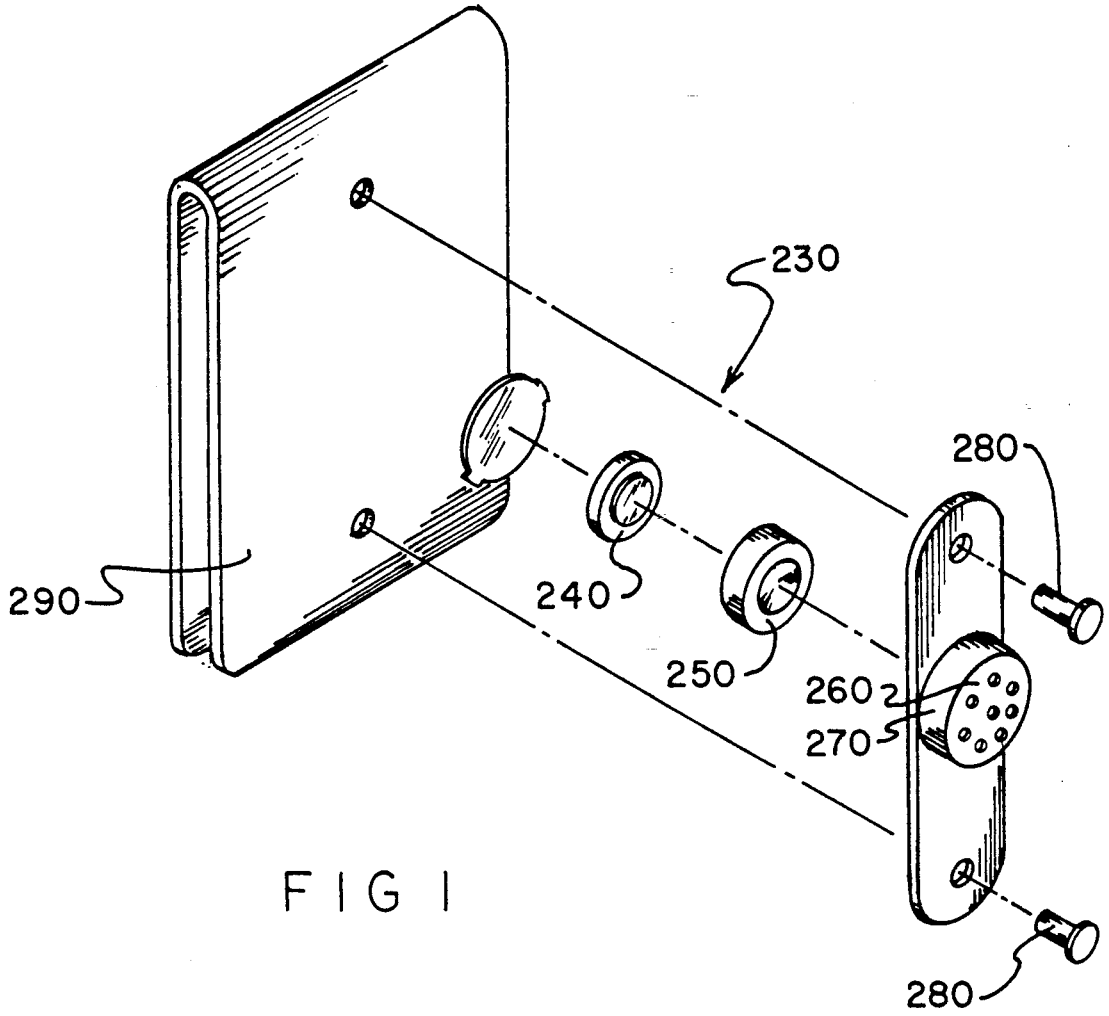
FIG. 1 is a view of a signalling device of the life vest of the present invention.
Figure 2:
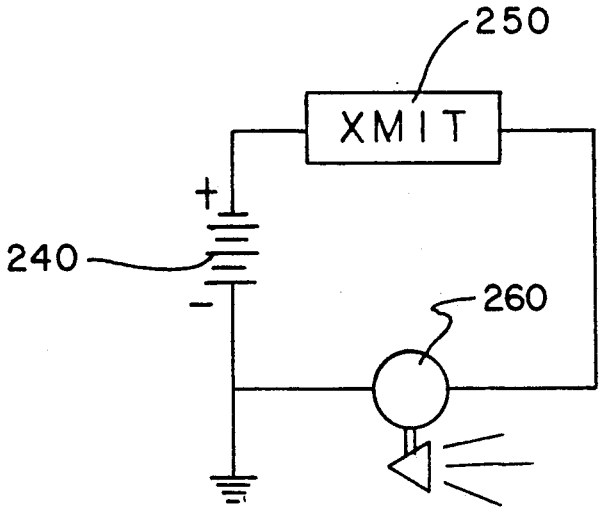
FIG. 2 is a schematic diagram of the signalling device of FIG. 1.
Figure 3:
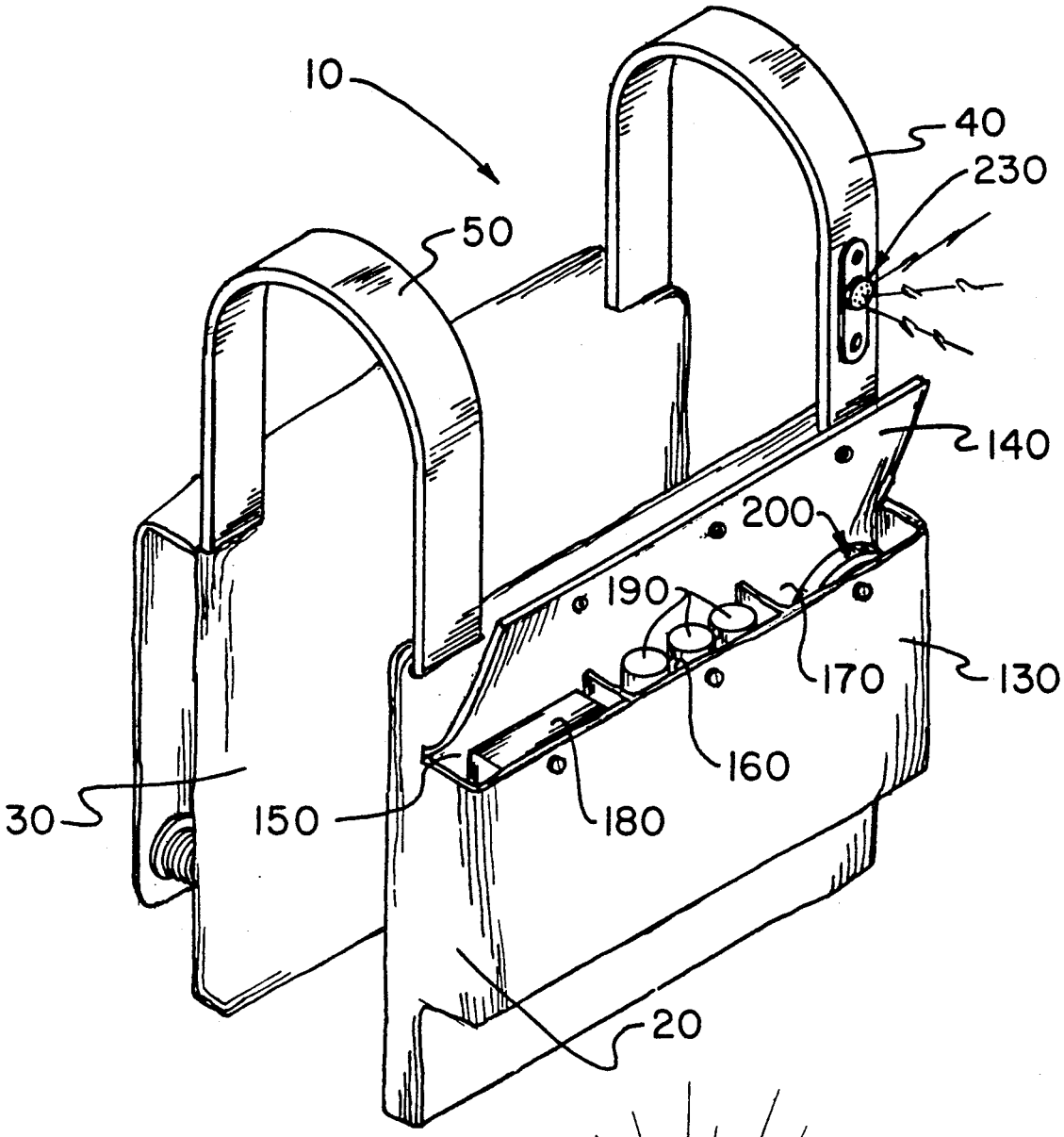
FIG. 3 is a perspective view of the front side of the life vest of the present invention.
Figure 4:
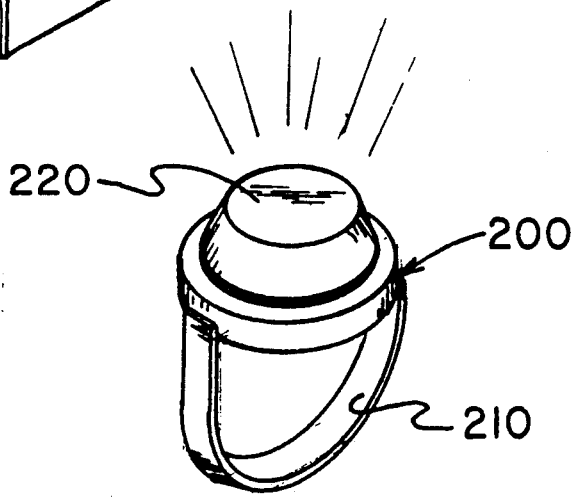
FIG. 4 is a perspective view of a strobe light of the life vest of the present invention.
Figure 5:
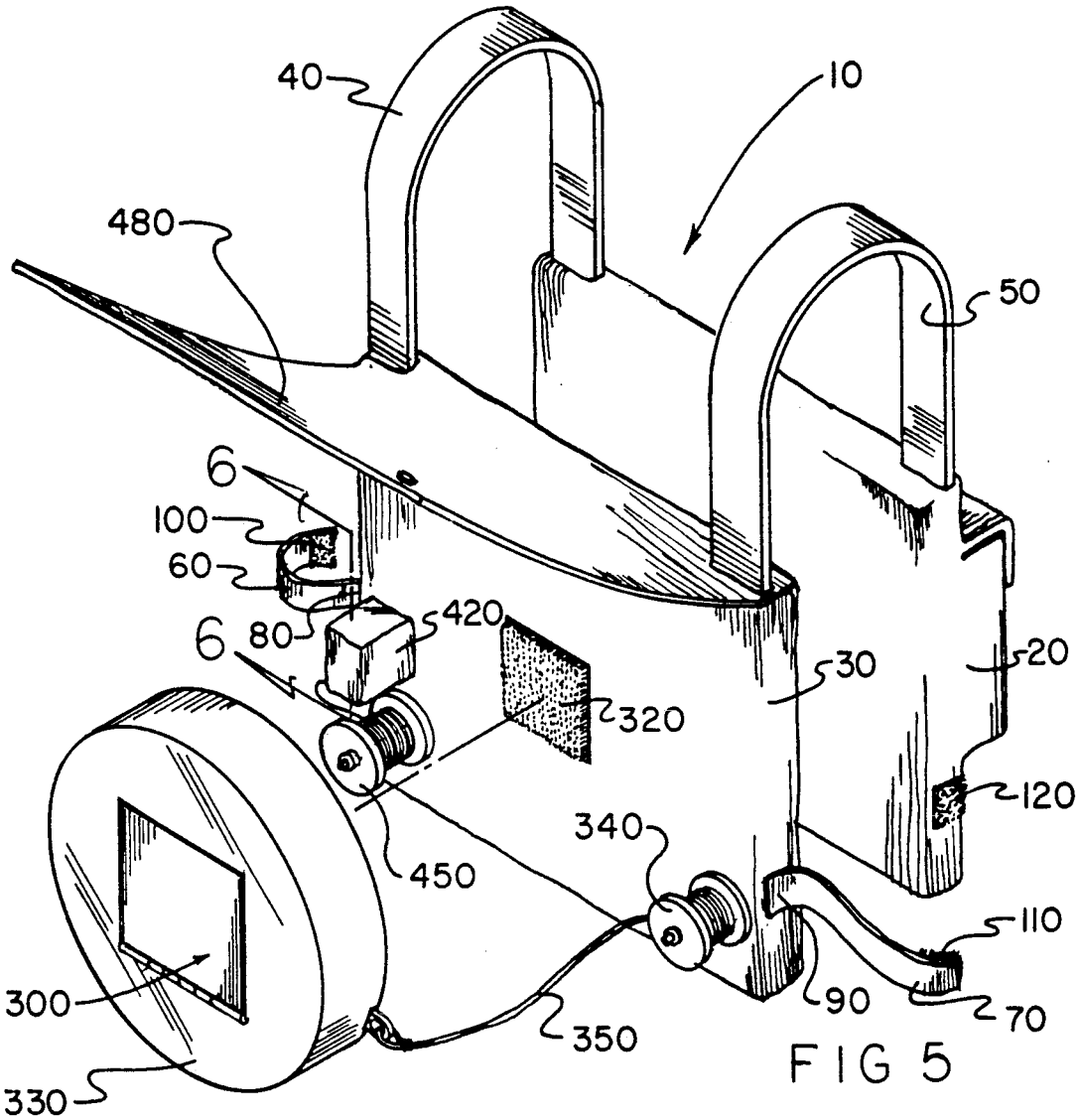
FIG. 5 is a perspective view of the back side of the life vest of the present invention.
Figure 6:
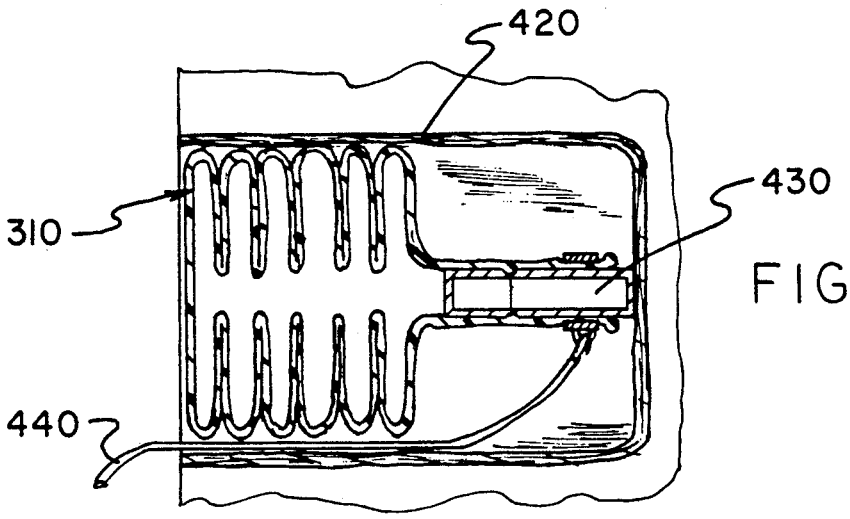
FIG. 6 is a view of the signal balloon of the present invention.
Figure 7:
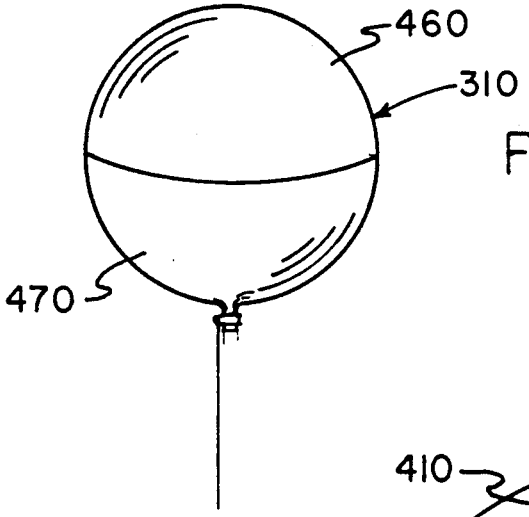
FIG. 7 is a view of the signal balloon of FIG. 6 when inflated.
Figure 8:
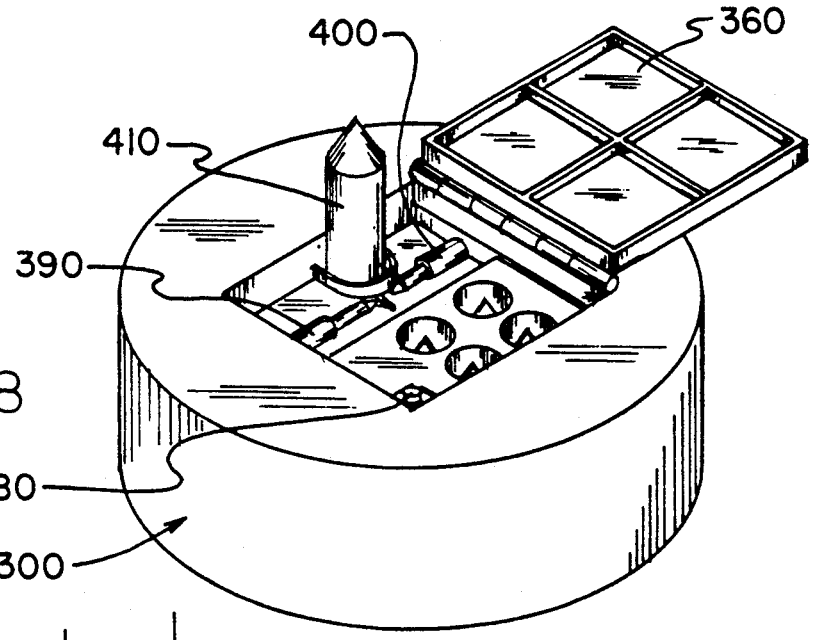
FIG. 8 is a perspective view of the flare signal of the present invention.
Figure 9:
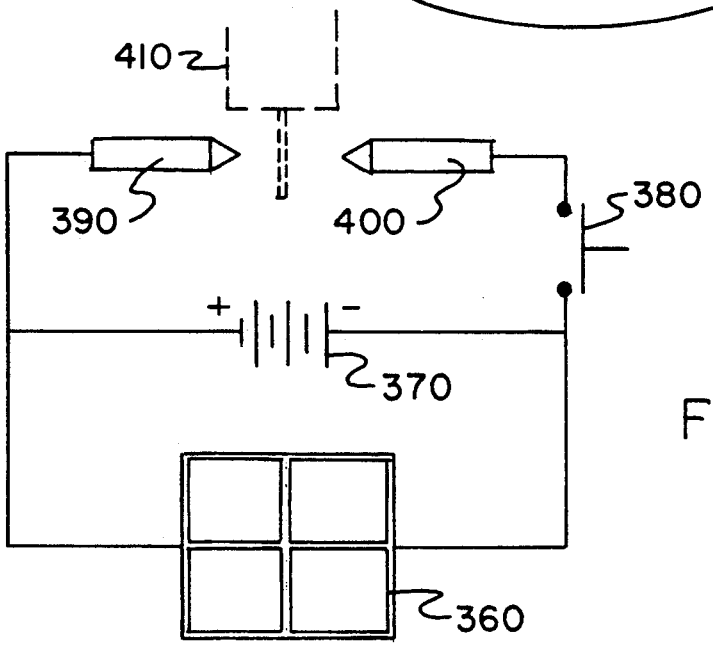
FIG. 9 is a schematic diagram of the flare signal of FIG. 8.

Turning to FIGS. 1 to 9, there is shown a life jacket designated generally by reference numeral 10. In its preferred form, the life jacket comprises a front section 20 and a rear section 30. The front section 20 is connected to the rear section 30 by a left shoulder strap 40 and a right shoulder strap 50. The rear section 30 further has a left side belt 60 and a right side belt 70. Both the left side belt 60 and the right side belt 70 are attached at one end, 80 and 90 respectively, to the rear section 30 and have a velcro strip, 100 and 110 respectively, attached to its other end. The front section 20 has a left velcro strip, not shown, and a right velcro strip 120 attached to the lower left side and lower right side, respectively, of the front section 20.

The right section 20 includes a pouch 130 having a flap 140 to close the pouch 130. The pouch is divided into three sections 150, 160 and 170. The first section 150 is a holder for a flare gun 180. Such a flare gun 180 is well known and the details of same form no part of the present invention. The second section 160 is a holder for flares 190 to be used with the flare gun 180 in the first section 150. Such flares 190 are well known and the details of same form no part of the present invention. The third section 170 is a holder for a strobe 200. The strobe 200 has a chin strap 210 and a strobe light 220. The strobe light 200 sits on the life jacket users head and the chin strap 210 is secured beneath the users chin.

Attached to a shoulder strap, 40 or 50, is a signal device 230. The signal device 230 includes a battery 240, a transmitter 250 and a speaker 260. The signal device 230 is enclosed in a housing 270 and is attached to the shoulder strap, 40 or 50, by rivets 280. The signal device 230 may also be attached to a belt buckle 290 or the like worn by the user.

Attached to the rear section 30 of the life jacket 10 is a solar and battery powered flare signal 300 and a signal balloon 310. The flare signal 300 is attached to the rear section 30 by a velcro patch, not shown, placed on the back of the flare signal 300 and a velcro patch 320 placed on the rear section 40 of the life jacket 10. The flare signal 300 is encompassed in a floatation device 330 and attached to a spool 340 by a tether 350. The spool 340 is attached to the rear section 30 of the life jacket 10.

The flare signal 300 includes a solar panel 360 and a battery 370 connected in parallel. Connected in parallel with these sources, 360 and 370, is a push button switch 380 and an anode 390 and a cathode 400. Between the anode 390 and cathode 400 are flares 410.

The signal balloon 310 is enclosed in a pouch 420. Attached to an open end of the signal balloon 310 is a metal cylinder 430 filled with helium gas and having a frangible seam and a tether 440. The tether 440 is also attached to a spool 450. The spool 450 is also attached to the rear section 30 of the life jacket 10. The signal balloon 310 is made of a combination of orange colored material 460 and aluminum foil 470.

The rear section 20 of the life jacket 10 further includes a cover flap 480 to cover the flare signal 300 and signal balloon 310 when not in use.

In operation, the life jacket 10 is placed on the body of the user in a manner so that the left shoulder strap 40 lays atop the user's left shoulder, the right shoulder strap 50 lays atop the user's right shoulder, the left side belt 60 is attached below the user's left arm and the right side belt 70 is attached below the user's right arm.

Should the user fall in the water the signal device 230 is automatically activated upon contact with water. The battery 240 powers both the transmitter 250 to transmit a signal which can be received by any receiver on a boat and the speaker 260 to produce an audible signal which can be heard by anyone in the immediate area.

The strobe 200 is to be placed and secured atop the user's head by the user and emits a strobe signal which can be seen by anyone in the immediate area. Use of the flare gun and flares is well known and a description of the process to use such forms no part of the present invention.

The flare signal 300 is removed from the velcro patch 320 on the life jacket 10 by the user when necessary and remains attached to the life jacket 10 by the tether 350. The user then flips the solar panel 360 into position and thus exposing the flares 410. When the user presses the push button switch 380 a spark develops between the anode 390 and the cathode 400 thus igniting the flare. The tether 350 allows the flare 410 to be discharged a safe distance from the user. The battery 370 acts as a substitute power source at night time when the solar panel 360 is not operational.

The signal balloon 310 is released by the user by pulling on the tether 440. Pulling on the tether 440 breaks the frangible seam on the metal cylinder 430. The signal balloon 310 is thus filled with helium and caused to rise. It can thus be seen by anyone within a large distance from the user. The signal balloon 310 remains attached to the life jacket 10 through connection to the tether 440 and the spool 450.

It is apparent from the above that the present invention accomplishes all of the objectives set forth by providing a new and improved life jacket. The life jacket is adapted to include numerous signalling devices including at least one signalling device activated automatically upon entry into water.

With respect to the above description, it should be realized that the optimum dimensional relationships for the parts of the invention, to include variations in size, materials, shape, form, function and manner of operation, assembly and use, are deemed readily apparent and obvious to those skilled in the art, and therefore, all relationships equivalent to those illustrated in the drawings and described in the specification are intended to be encompassed only by the scope of appended claims.

While the present invention has been shown in the drawings and fully described above with particularity and detail in connection with what is presently deemed to be the most practical and preferred embodiment(s) of the invention, it will be apparent to those of ordinary skill in the art that many modifications thereof may be made without departing from the principles and concepts set forth herein. Hence, the proper scope of the present invention should be determined only by the broadest interpretation of the appended claims so as encompass all such modifications and equivalents.

What is claimed as being new and desired to be protected by Letters Patent of the United States is as follows:

1. A new and improved life saving device comprising:
a life vest having
a front side including:
a pouch divided into first, second and third sections,
a cover to close the pouch,
a first fastener element on a lower right side of the front side, and
a second fastener on a lower left side of the front side;
a rear side including
a fastener element,
a first strap attached to a lower right side of the rear side, and
a second strap attached to a lower left side of the rear side;
a right shoulder strap attached between an upper right part of the front side and an upper right side of the rear side, connecting the front and rear sides; and
a left shoulder strap attached between an upper left part of the front side and an upper left side of the rear side, connecting the front and rear sides;
a flare gun held within the first section of the pouch on the front side of the life vest; and
flares held within the second section of the pouch on the front side of the life vest;
further including:
a strobe held within the third section of the pouch on the front side of the life vest,
a signal balloon attached to the rear side of the life vest,
a first spool attached to the rear side of the life vest having a tether, the tether being attached to the signal balloon,
a flare signal attached to the rear side of the life vest, and
a second spool attached to the rear side of the life vest having a tether, the tether being attached to the flare signal.

2. The invention of claim 1 further including:
a signal device having:
at least one rivet for attachment of the signal device to the life vest,
a transmitter,
a speaker, and
a battery attached between the transmitter and speaker, wherein the signal device is activated upon contact with water.

3. The invention as claimed in claim 1 wherein the rear side of the vest also comprises a cover flap for covering the signal balloon, flare signal and first and second spools.

4. The invention of claim 3 wherein the flare signal is able to float on water.

5. The invention of claim 4 wherein the flare signal is both battery powered and solar powered.

6. The invention of claim 5 wherein the flare signal is activated by a push button.

7. The invention of claim 6 wherein the signal balloon includes a metal casing having a frangible seam and helium within the metal casing wherein the frangible seam is broken by pulling on the tether and the balloon is filled with the helium.

8. The invention of claim 7 wherein the rear side of said life vest includes a velcro patch and said flare signal is connected to the velcro patch on the rear side of the life vest.

9. The invention of claim 8 wherein the strobe comprises a strobe light and a chin strap for placement on a user's head.

* * * * *